United States Patent [19]

Levasseur et al.

[11] 4,008,792

[45] Feb. 22, 1977

[54] VEND CONTROL CIRCUITS CAPABLE OF VENDING DIFFERENT QUANTITIES AT DIFFERENT PRICES

[75] Inventors: Joseph L. Levasseur, St. Louis; Larry D. Lee, Kirkwood, both of Mo.

[73] Assignee: H. R. Electronics Company, High Ridge, Mo.

[22] Filed: Aug. 20, 1975

[21] Appl. No.: 606,173

[52] U.S. Cl. ..... 194/1 N; 194/10

[51] Int. Cl.[2] ..... G07F 5/22

[58] Field of Search ..... 194/1 N, 1 M, 2, 9, 194/10, DIG. 3; 133/2

[56] References Cited

UNITED STATES PATENTS

| | | | |
|---|---|---|---|
| 2,323,255 | 6/1943 | Sutherland | 194/10 |
| 2,941,644 | 6/1960 | Zeigle et al. | 194/10 |
| 3,770,089 | 11/1973 | Verduin et al. | 194/1 N |
| 3,841,456 | 10/1974 | Levasseur | 194/1 N |

*Primary Examiner*—Drayton E. Hoffman
*Assistant Examiner*—Joseph J. Rolla
*Attorney, Agent, or Firm*—Charles B. Haverstock

[57] ABSTRACT

A control circuit for vending and like machines which includes an electric circuit with circuit elements and connections which enable vending machines to vend different items costing different amounts and in different quantities with and without quantity discount capability and to return change to the customer for any excess amount deposited.

15 Claims, 4 Drawing Figures

VEND CONTROL CIRCUITS CAPABLE OF VENDING DIFFERENT QUANTITIES AT DIFFERENT PRICES

The vending industry has gone through substantial changes in recent years to meet the ever increasing complexities and demands of customers and to enlarge the capability of vending machines. The present invention represents another step in the process of making vending machines more versatile and better able to meet the needs of customers. The present control means are especially useful to control machines that can vend a variety of different priced items or goods or services and in different quantities. An example of a vending machine on which the subject control is particularly applicable is one that is able to vend different quantities of different priced postage stamps and to make change when necessary. The present improvements are also adaptable for use in conjunction with many different kinds of vending control circuits including, for example, the control circuit disclosed in Levasseur U.S. Pat. No. 3,841,456, dated Oct. 15, 1974, and assigned to Applicants' assignee. The present means are also adaptable for use with multi-price as well as single price vending systems and they lend themselves to being constructed and programmed to accommodate many different vending situations where it is desired to vend different priced goods such as different priced postage stamps, candy, and many other products and services and in different quantities. This is possible because the present control means include means to produce an additional parameter in its logic and control circuit portions which enables the circuit to control the dispensing of different quantities of a product or service within the capacity of the circuit and of the vending machine even where more than one product or service is available from the same machine.

The present means can be added as a modification to an existing control circuit such as that disclosed in the above-identified Levasseur patent, and this can be done relatively easily using relatively little additional equipment and circuitry most of which incorporates structural and operational characteristics and features similar to circuits and circuit elements already in existence. For example, the present improvements can be added to existing devices in some cases by adding one or more integrated circuit chips such as one or more C-MOS chips which may or may not be of a known construction. These additions substantially increase the versatility and utility of vending devices controlled thereby, and enable such devices to perform many additional and useful functions not presently available. These include functions akin to computer type functions whereby the control circuits for a vending machine are able to be preset to determine and control how many articles at different prices can be vended for any given deposit, they can control the vending of products until the amount of a deposit less some refund, if required, has been used up, and at the same time the present control circuit improvements can include means to determine quantity discounts, if necessary. The capability of being preset to determine quantity discounts is an important additional aspect and function of the present means and has application to many vending and related situations.

It is therefore a principal object of the present invention to substantially increase the versatility and functional capability of vending machines.

Another object is to enable vending machines to vend different quantities of different products at different prices taking into account the amount of each deposit and amounts to be refunded.

Another object is to provide a vending control circuit which is particularly applicable to control the vending from a single vending machine of items costing different amounts such as postage stamps and the like and where the vending machine can be programmed to vend one or more of such itmes in different quantities and for different amounts deposited.

Another object is to teach the construction and operation of a novel vending control circuit capable of automatically figuring quantity discounts associated with different articles and different numbers of articles being vended.

Another object is to substantially increase the versatility and usefulness of vending machines without substantially increasing the cost of the control circuits employed therein.

Another object is to increase the versatility of vending machines and the like without substantially increasing the size or complexity of the control circuits therefor.

Another object is to make it possible for a vending control circuit to combine multiple price with multiple product capability for different deposits and to include the further capabilities of figuring quantity discounts and proper refunds.

Another object is to increase product and price selectivity to customers of vending machines.

Another object is to enable a vend control circuit to control the vending of different times and quantities of times under control of one or of a plurality of different vend outputs within the capacity of a particular control circuit.

These and other objects and advantages of the present invention will become apparent after considering the following detailed specification which describes several preferred embodiments thereof in conjunction with the accompanying drawings, wherein.

Figure 1:
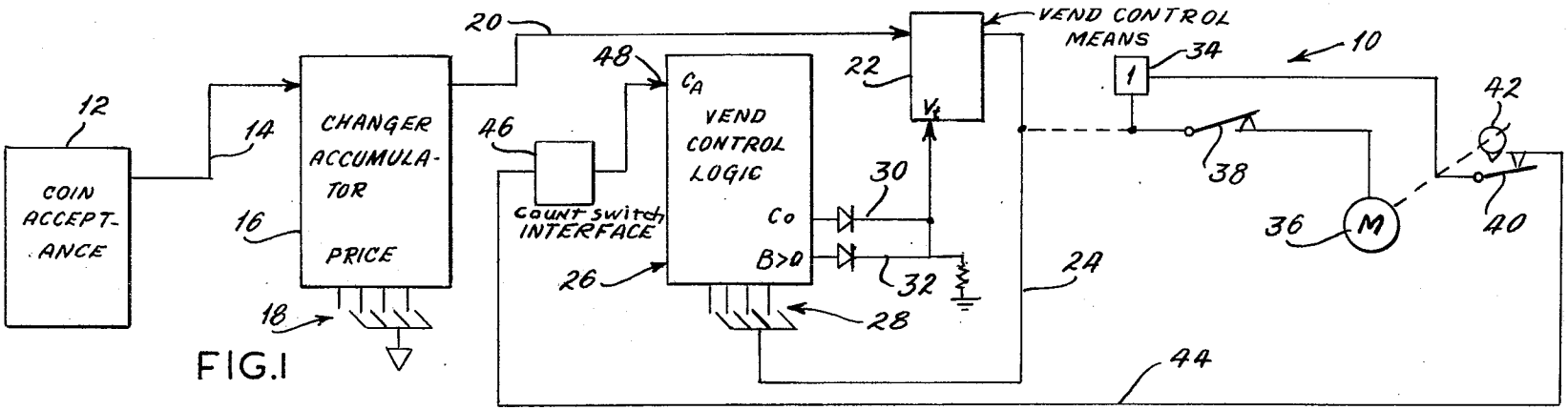
FIG. 1 is a simplified block diagram of a vending control circuit constructed according to the present invention.

Referring to the drawings more particularly by reference numbers, number 10 identifies a simplified block diagram of a vend control circuit. The circuit includes a coin acceptance unit 12 where coins are deposited and output signals produced to represent the value of each deposited coin. The outputs of the coin acceptance unit 12 are fed on lead 14 as inputs to a change accumulator circuit 16 which includes means to accumulate the total value of all coins deposited during each vend cycle. The accumulator circuit 16 has a second set of inputs identified generally by number 18, and these inputs which are labeled "price", are used to enter the price into the accumulator means 16. The amount deposited and the price entries can both be entered in binary form. The accumulator 16 produces outputs which appear on lead 20, and the lead 20 is connected to an input of vend control circuit means 22. The circuit means 22 has an output lead 24 called the quantity output lead connected as an input to another control circuit 26 sometimes called the vend control logic circuit. The signals fed on the lead 24 are applied to inputs 28 and are entered into the circuit 26 as quantity inputs which control the quantity of articles to be vended for any particular deposit.

The circuit 26 has a plurality of inputs and outputs including in the usual case a plurality of control inputs 28. The vend control circuit 22 receives other inputs from the circuit 26 on leads 30 and 32, which leads are connected respectively to the $C_o$ and the $B > 0$ output terminals of the circuit 26. These outputs from the circuit 26 are applied to the $V_t$, or vend termination input terminal of the vend control circuit 22. The vend control circuit 22 also includes means to enable a vend operation to take place whenever an amount accumulated in the accumulator circuit 16 by deposits in the coin acceptance means 12 at least equals the vend price as entered therein at the inputs 18. After a vend has been initiated, the vend control circuit will receive indications on lead 20 to cause a vend operation to take place. Each time this happens the vend motor 36 will be energized and in so doing will produce a vend operation and will also operate switches 38 and 40. The switch 40 is driven by cam 42 and controls the feedback of the vend signals on lead 44 to count switch interface 46 and to the $C_A$ input terminal 48 of the vend control logic circuit 26. These inputs are produced by voltage source 34 and are compared in the circuit 26 with the quantity entry made at 28. Each time another vend is made another signal is fed back until the amount entered into the circuit at the $C_A$ input lead 48 equals the quantity originally entered at 28. When this happens the gating action of the circuit 26 on output leads 30 and 32 will cause a signal to be sent to the reset input terminal R of the vend control circuit 22 to reset the circuit and terminate the vend operation. Thus it can be seen that the simple circuit of FIG. 1 can be used to control the vending of a predetermined quantity of items at a predetermined cost for a single total deposit.

Figure 2:
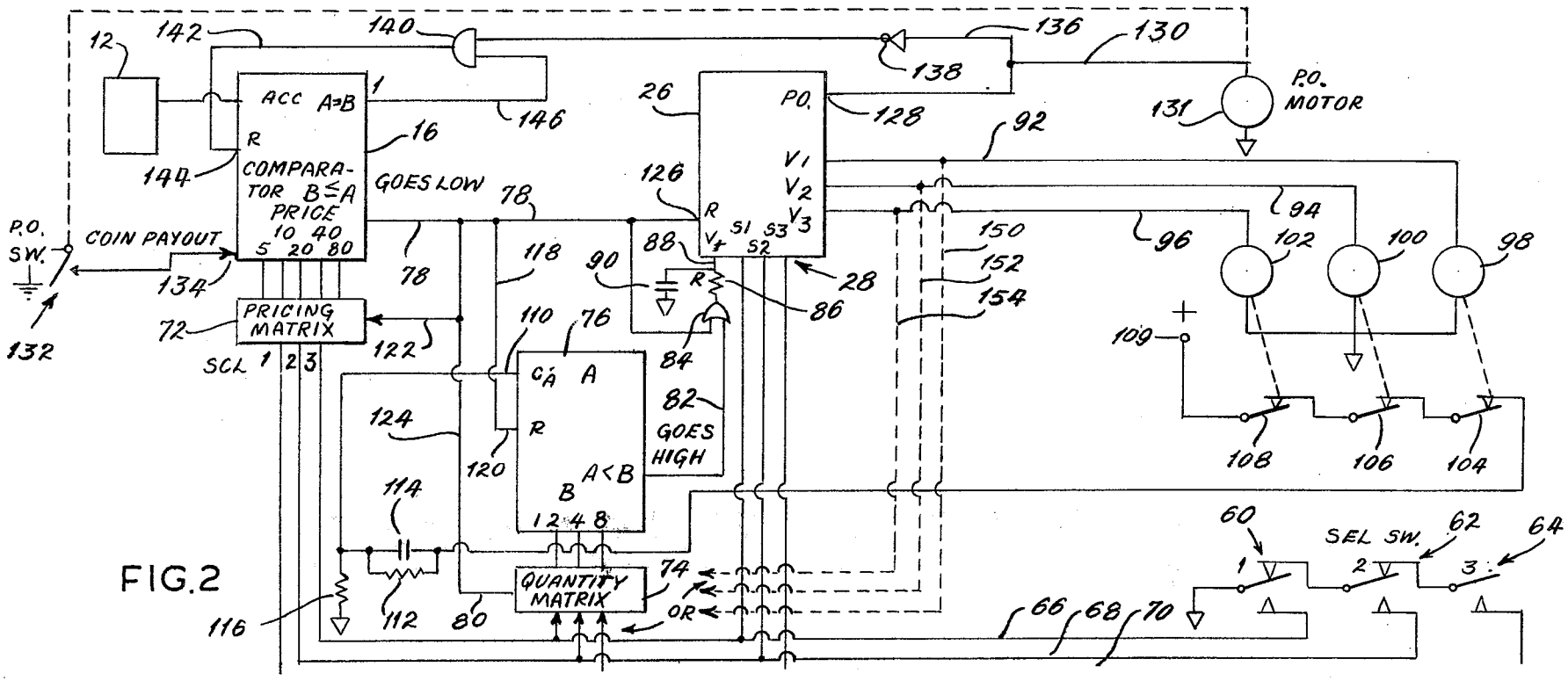
FIG. 2 is a somewhat more detailed block diagram of a vending control circuit incorporating the teachings of the present invention.

The circuit shown in FIG. 2 incorporates other features including features which gives it increased versatility and capability over the circuit of FIG. 1. These include the capability of vending different quantities of different priced articles with or without quantity discounts. The circuit of FIG. 2 also has the capability of refunding amounts deposited in excess of the selected total vend price. It should be noted, however, that some of the circuits and circuit elements and connections may be similar or identical to the circuits and circuit elements and connections of FIG. 1 and in the referenced Levasseur case. Certain features of the present construction are in addition to the earlier construction and are provided to increase versatility. However, the manner in which the added elements are used in the present construction, the way they are connected into the circuit, and the way they function to increase its usefulness and versatility are important. The elements of the circuit of FIG. 2 which are somewhat similar to corresponding elements of the more simplified construction of FIG. 1 are similarly labeled but in most cases it will be necessary to describe them in even greater detail because of additional functions that are performed.

The circuit of FIG. 2, like the circuit of FIG. 1, has a coin unit 12 where coins or other entries or deposits are made and signals produced accordingly. The circuit also has a changer accumulator circuit 16, also identifed as a comparator circuit, a vend control logic circuit 26 and a plurality of vend motor to be described. The circuit of FIG. 2 also has a plurality of operator actuatable vend selection switches 60, 62 and 64, any one of which can be selected for operation by a customer depending on the articles and quantity of articles desired, as will be described. The price selection switches 60, 62 and 64 are connected by respective leads 66, 68 and 70 to the inputs 28 of the vend control logic circuit 26, to a pricing matrix circuit 72 and to quantity matrix circuit 74. The input circuits so connected may be gate type circuits that produce a desired binary condition in the respective control circuits. In the circuit as shown, the three selector switches 60, 62, and 64 have their movable contacts and their normally closed stationary contacts connected in a series circuit to ground. When a selected one of the switches is actuated, its movable contact moves out of engagement with its associated normally closed contact and into engagement with its normally open contact to complete a circuit from ground to the respective inputs of the matrices 72 and 74 and to the selected inputs to the vend control circuit 26. Depending on which of the switches is actuated by the customer determines the price that the pricing matrix 72 will enter into the comparator accumulator circuit 16 and the quantity of items to be vended that will be entered into another comparator circuit 76 by way of the quantity matrix circuit 74. The selected price and quantity will be compared in the respective comparators 16 and 76 with other entries therein and will take into account the amount deposited to determine if the customer is entitled to the selected vend and to a refund. The pricing matrix can also be programmed to provide a quantity discount depending upon the quantity of a particular item selected by the customer. If a quantity discount is called for it is a simple matter to produce by properly presetting the binary inputs entered into the matrices 72 and 74 by actuations of the selector switches. This feature will be described more in detail later.

The present circuit substantially enlarges the versatility of a vending machine by enabling control not only of the vending of articles or services at different prices but also of the vending of different amounts or quantities of articles or services at the different prices. As indicated a typical application where this capability is needed is in the vending of postage stamps and other like articles and services although the circuit is not limited to any particular use. In the postage stamp situation the customer may want to buy different quantities of different value stamps taking into account the amount of his deposit. For example, a customer may want to buy two 10-cent stamps by depositing a quarter. To accomplish this he deposits his quarter and depresses the appropriate selector switch which operates to establish appropriate circuits to the price and quantity matrices 72 and 74. These circuits connections would result in the vending of two 10-cent stamps and the refunding of a nickel.

Another customer, for the same deposit, might desire to purchase three 8-cent stamps and obtain the appropriate change by 1 cent. This requires actuation of a different selector switch to enter the different price and the different quantity and to obtain the 1-cent refund.

Many other combinations are also possible, and it is also contemplated to use the present price-quantity-refund capability to vend many different kinds of products and services in this way. A few examples of other products and services that can be vended in this way are items such as candy, toys, hardware articles such as nails and screws and the like, items such as tickets, chances including lottery tickets, time on a car wash operation, and many other items and services. This list is suggestive only of some of the broad categories of goods and services that might be vended using the present means. Also as indicated the present control means are easily adaptable to providing quantity discounts which is an important added capability and as a general rule this feature does not substantially increase the cost or complexity of the subject means but only effects the entries made into the various circuit portions from the customer selector switches.

Referring again to FIG. 2, the vend control circuit 26 is shown controlled by inputs it receives from two separate comparator circuits instead of from only one as in the circuit of FIG. 1. The output of the pricing comparator circuit 16 appears on lead 78 whenever the amount deposited at least equals the vend price as established by the pricing matrix 72. This output is applied among other places to the control input on lead 80 to the quantity matrix 74, and it has an effect on how the selected inputs from the actuated selector switch 60, 62 or 64 are entered into the quantity comparator circuit 76. Outputs of the circuit 76 are also applied on lead 82 to one input of OR gate 84 which has its output side connected through resistor 86 to a control input or vend termination ($V_t$) 88 of the vend control circuit 26. The other input to the OR gate 84 is from the output of the comparator circuit 16 on the lead 78. A grounded capacitor 90 is connected to the vend termination terminal 88 and delays the inputs applied to the terminal 88 for reasons which will be explained later.

The vend control circuit 26 has vend output connections 92, 94 and 96 which control different respective vend producing means 98, 100 and 102. Various kinds of vend producing means can be used for this purpose including stepper types which produce pulses that count out a predetermined number of items when energized. In FIG. 2 the vend producing means 98–102 are operatively associated with respective series connected normally closed switches 104, 106 and 108 which are connected in series in a circuit between a positive voltage source 109 and count input terminal ($C_A$) 110 of the quantity comparator circuit 76. This circuit feeds back signals for each article or item or service vended until the required number of vends has been satisfied as indicated by a condition of equality having been reached in the comparator 76. A condition of equality occurs in the comparator 76 when the number of vend signals received at the $C_A$ input 110 is the same as the quantity entered into the circuit 76 by the quantity matrix 74. The feedback circuit from the switches 104, 106 and 108 to the $C_A$ input 110 includes an RC filter circuit of resistor 112 and capacitor 114 and grounded resistor 116 connected as shown. The purpose of the filter circuit is to establish and maintain a negative voltage on the input 110 which produces a positive going pulse whenever any one of the switches 104, 106 or 108 recloses. The characteristics of these signals depend on the RC time constant of the filter circuit.

The output 78 from the pricing comparator circuit 16 has other control connections which are important to the operation. These include a connection on lead 118 to reset R input 120 of the quantity comparator 76 which operates to reset the quantity comparator 76 whenever a positive voltage condition occurs on the output lead 78 at a time when the price comparator 16 is reset. Such a condition exists whenever vend and payback operations are completed.

The output 78 has other connections on leads 122 and 124, respectively, to the pricing matrix 72 and to the quantity matrix 74. These connections are control connections which function when there is a high condition present to inhibit the matrices from receiving other inputs during a vending operation. Finally, the output 78 has a connection to the reset (R) input 126 of the vend control circuit 26 to reset this circuit at the conclusion of a vend and payout operation.

Unlike the circuit of FIG. 1, the circuit 26 of FIG. 2 has a payout output terminal 128. This terminal is connected by lead 130 to the payout motor 131 shown mechanically connected to drive payout switch 132 that is connected in circuit between ground and the payout input terminal 134 of the price comparator circuit 16. Each time the payout motor 131 operates the switch 132 a signal is fed to the terminal 134 to increase the amount accumulated in the price entry portion of the comparator circuit 16. This will continue until the amount in the price portion equals the amount in the deposit portion of the comparator 16. When the condition of equality is reached a signal will be generated to terminate the payback operation and to reset the various circuits as already described.

Certain of the signals present on the payout terminal 128 of the circuit 26 are also applied on lead 136 to and through diode 138 as inputs to AND gate 140 which has its output connected by lead 142 to the reset (R) input 144 of the comparator circuit 16. The AND gate 140 receives other inputs on lead 146 from the A = B output terminal of the comparator circuit 16. This means that for the comparator circuit 16 to be reset it is necessary for two conditions to simultaneously occur; namely, that the two accumulator portions (A and B) of the comparator 16 have the same amounts entered in them (represented by an output at the A = B terminal 146), and that a signal be present at the output terminal 128 of the circuit 26 to indicate that a payout operation has been completed. A similar set of conditions will be available under conditions where no payback is required.

The circuit of FIG. 2 can be used to control various forms of vending machines as explained, and operates when a customer deposits coins or otherwise makes a deposit in the coin unit 12. This causes impulses to be fed to one of the two accumulator portions (the A portion) of the comparator circuit 16. The operator then depresses a selected one of the selector switches 60, 62 or 64 to cause input signals, which are lows because of the ground, to be applied to and through selected inputs of the pricing matrix 72 and of the quantity matrix 74. The pricing matrix 72 applies the total price of the selected articles or services, regardless of the number of individual items or services involved, to the B accumulator portion of the comparator circuit 16 for comparison with the amount representing the deposit in the A portion. If the accumulation in the A portion equals or exceeds the amount in the B portion an appropriate output will be present on the B ≤

A output lead 78 and on the associated input to the OR gate 84 to cause a vend operation to be initiated by the vend control circuit 26.

At the same time the same control output present on the B ≤ A terminal 78 is applied to the quantity matrix 74 which has by this time received an appropriate selection input depending on which of the selector switches 60, 62 or 64 was actuated. The combined signals fed to the quantity matrix 74 result in an appropriate entry in the B accumulator portion of the quantity comparator circuit 76, and as long as the amount in the A portion of the accumulator 76 is less than the amount entered in the B portion output signals will be produced at the A < B output 82 for applying to the associated input to the OR gate 84. This will cause vends to take place, and each vend will in turn feed back an appropriate signal to the $C_A$ input 110 of the circuit 76 in the manner already described.

In the condition described with an adequate deposit and a selection having been made, the circuit will enable vends to take place as required depending on what amount is entered into the B accumulator portion from the quantity matrix 74. Each time a vend is made the appropriate of the vend switches 104, 106 or 108 will be actuated by its associated vend control means 98, 100 or 102, and when this happens a signal will be fed to the $C_A$ input on lead 110 for accumulation in the A accumulator portion of the comparator 76. This will continue until the amount entered in the A portion equals the amount entered in the B portion to indicate that the required number of vends has taken place. When this occurs it causes a change to a low on the output on lead 82 to the gate 84, and if at the same time the output on lead 78 goes low, it will operate to reset the circuits 26 and 76. If a payout or refund operation is required the reset signal on the lead 78 will be delayed by operation of the payback circuit which feeds back an appropriate signal for every coin refunded until there is an output signal present on the A = B output terminal 146 to cause the gate 140 to generate a reset signal for applying to the reset input terminal 144 of the price comparator 16 as already described.

The price and quantity matrices 72 and 74 can have many different forms and connections so as to produce different desired inputs to the associated comparator circuits 16 and 76. In the usual situation the matrices will be gate or gate-type circuits which operate when inputs are received to enter appropriate amounts in the associated binary stages of the respective B accumulator portions of the circuits 16 and 76. In the circuit as illustrated this depends on which of the selector switches 60, 62 or 64 is actuated. For example, if a quarter is deposited it is possible that one of the selector switches will be connected to enter 25 cents in the B portion of the pricing comparator 16 and at the same time to enter two in the B portion of the quantity comparator 76. In the example mentioned above this will cause two ten-cent stamps to be vended and will produce a five-cent refund. Several different circuit means can be used to produce the desired number of vends as will be described.

For the same quarter deposit actuation of another selector switch may enter 24 cents in the binary form in the B portion of the price compartor 16 and binary 3 in the B portion of the quantity comparator 76. In this case the machine will produce appropriate outputs to vend three 8-cent stamps and will refund 1 cent. Many other combinations of deposits, vend prices, quantities to be vended and refunds are possible.

In addition to the combinations mentioned above, it is possible with little or no change in the circuit to cause the operation of one or more of the selector switches to produce a vend price that is less by some predetermined amount than the combined unit cost of the selected articles. It is also possible to set the circuits so that the vending machine will vend one or more articles in excess of the actual deposit. For example, if a customer deposits a quarter and actuates a selector switch for vending 5-cent items the circuit can be set so that the machine will vend five articles and refund a nickel, or the circuit can be set to vend six articles with or without any refund, and so on. In other words, by properly programming or connecting the pricing and quantity matrices 72 and 74 to the selector switches and to the respective comparators, various combinations of vend prices, quantities, and quantity discounts and refunds can be given as desired.

FIG. 2 shows in dotted outline three optional connections which can be used with, or instead of the connections shown in solid outline between the leads 66, 68 and 70 and the quantity matrix 74. The optional connections which are on dotted leads 150, 152 and 154 are connected between the respective vend output leads 92, 94, and 96 of the vend control circuit 26 and the inputs to the quantity matrix 74. These connections function similar to corresponding leads 66, 68 and 70 to make appropriate entries into the B accumulator portion of the quantity comparator 76 by way of the quantity matrix 74. In this alternate or optional construction it is still necessary to have the leads 66, 68 and 70 connected to the pricing matrix 72 and to the circuit 26. This means that the inputs fed to the quarter comparator circuit 76 from the quantity matrix 74 will come from the vend outputs produced on leads 92, 94 and 96 in the output of the vend control circuit 26 rather than directly from the selection switches 60, 62 and 64. It is a relatively simple matter to make these circuit changes.

Each of the selector switches, of which there may be any number, is connected to cause a particular combination of functions to take place. However, for any one wiring of the switch and matrix circuits only one set of functions can be produced. By changing the connections so as to make different entries in the comparators 16 and 76 different sets of functions can be performed by the same switch. The possibilities in this regard are very great and can be accomplished by using manual switches in the circuits of the matrices.

Figure 4:
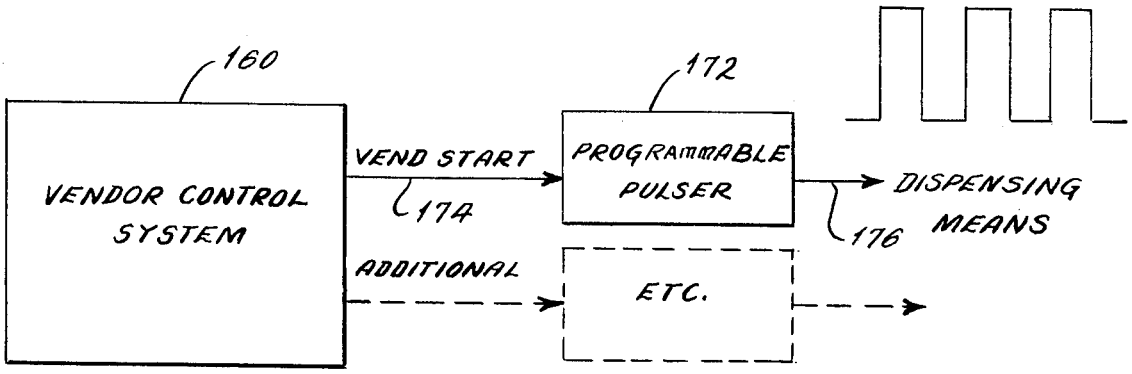
Figure 3:
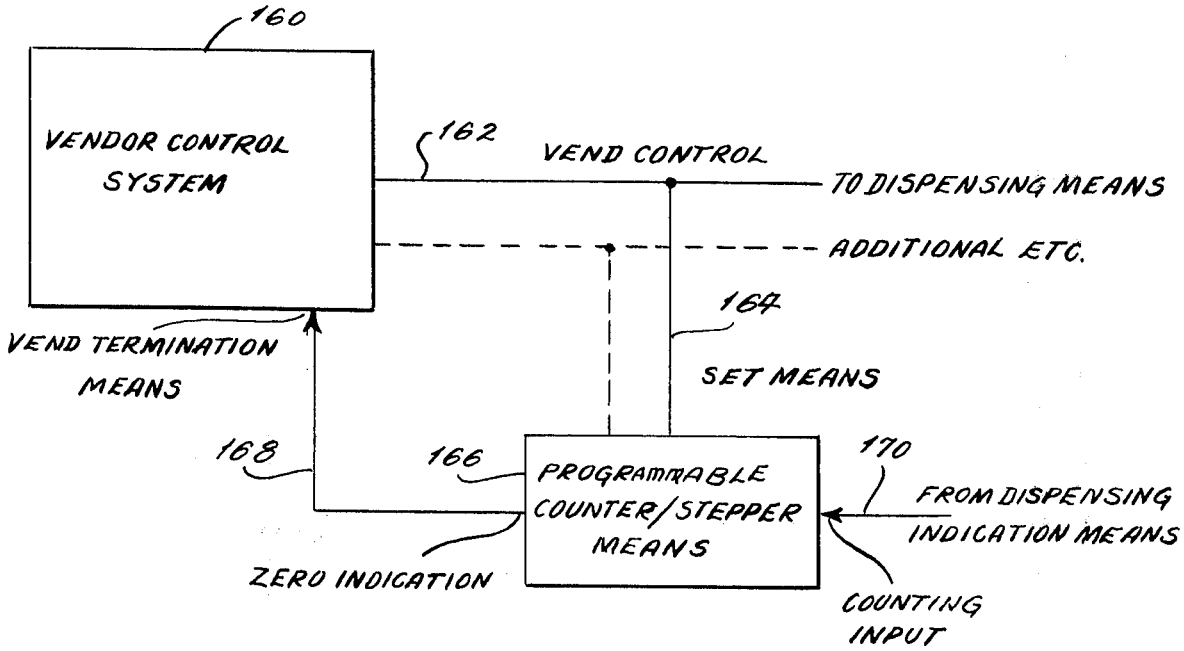
FIG. 3 is a simplified block diagram showing one way to count items being vended until an amount deposited has been used up; and, FIG. 4 is another simplified block diagram showing the type of vend output control signals that can be produced by the subject control circuit.

FIGS. 3 and 4 are simplified diagrams which are included as an aid to the understanding of certain of the basic functions of the present circuit. In FIG. 3 the block entitled vendor control system can be almost any standard commercially available changer 160 such for example as those disclosed in Shirley U.S. Pat. No. 3,307,671; Levasseur U.S. Pat. No. 3,841,456 and Levasseur U.S. Pat. No. 3,894,220. The changer system 160 produces vend control outputs on lead 162 which control dispensing means in a vending or other device. These outputs are also fed back on lead 164 to a circuit labeled "programmable counter stepper means" 166 which in turn feeds vend termination signals back to the system 160 on lead 168. These signals are produced whenever there is a zero ouput indication present on the output of the system 160. The circuit 166 also receives quantity input signals on lead 170 each time another article or service is vended. The circuit of FIG. 3 illustrates the basic concepts of the present invention which include producing a quantity of vends at a selected unit vend price until the amount of a deposit is used up. No known vending control circuit has this capability. The circuit of FIG. 3 may have one or more alternate vend control connections one of which is shown in dotted outline to illustrate another vending possibility using the same basic circuit.

FIG. 4 illustrates a form of means for the output of the vendor control system 160 of FIG. 3, said output means including a programmable pulser 172 which is connected to the system 160 by lead 174. When a dispensing or vending operation is called for, the system 160 produces an output vend start signal which energizes the pulser 172. The pulser then produces a sequence of output pulse shown as square wave pulses, the number of which corresponds to the number of quantity of articles to be vended. These pulses are fed to the dispensing means on lead 176. Each pulse produces a separate vend operation. For example, each pulse can be used to dispense a postage stamp or some other item or service. In dotted outline a second output circuit is shown which when energized produces a different number output pulses for causing a different number of vends of the same or of different unit priced articles or services.

From the description it is apparent that the subject means can be used to control the vending of many different kinds and prices of articles and services including providing, price, quantity and refund selection and control as well as quantity discount capability. This makes for a very versatile vending control circuit and greatly expands the possibilities for vending. As indicated the present means are relatively easily adaptable for use with many known and existing systems, and for the most part can be constructed using known and available components. The present means are especially adaptable to being constructed using integrated circuit components and chips including chips that may have similar structural and operational characteristics to those used in other known control circuits such for example as are used in the circuits disclosed in Levasseur U.S. Pat. No. 3,841,456.

Thus there has been shown and described a versatile vend control circuit that satisfies and fulfills all of the advantages and objects sought therefor. It will be apparent to those skilled in the art, however, that many changes, modifications, variations and other uses and applications for the subject means are possible. All such changes, modifications, variations and other uses and applications which do not depart from the spirit and scope of the invention are deemed covered by the invention which is limited only by the claims which follow.

What is claimed is:

1. A vend control circuit comprising a coin unit for receiving the deposit of coins and for producing output signals to represent the value of each coin deposited, a vendor control system operatively connected to the coin unit including means for producing a vend signal to initiate a vend function whenever the amount entered therein from the coin unit at least equals the total amount of a selected vend, vend producing means operatively connected to the vendor control system and responsive to signals produced thereby, customer actuatable means including means operable to select different quantities of articles at a selectable unit vend price including means to establish the vend price and the quantity of articles to be vended, entry means having a first input operatively connected to the means to establish the quantity of articles to be vended and a second input, said vending producing means including means for generating an output signal for each article that is vended, means connecting the vend producing means to the second input of the entry means, and means to terminate a vending operation when the number of articles vended corresponds to the quantity of articles selected by the customer to be vended.

2. The vend control circuit defined in claim 1 wherein the customer actuatable means include a plurality of different selector switches and means associated with each of said switches for producing a first output to represent a selected unit vend price and a second output to represent the desired quantity of articles to be vended at the selected unit vend price.

3. The vend control circuit defined in claim 1 wherein the vend producing means includes a plurality of vend motors corresponding to the number of different selectable unit vend prices, a switch associated with each of said motors, and means operatively connected to said switches and to the vendor control system for feeding back to the vendor control system a signal for each article vended under control thereof.

4. A control circuit for a vending machine capable of vending one or more products at a selected one of several unit vend prices comprising a credit unit for receiving amounts of credit entered therein by a customer, a first comparator circuit having first and second accumulator portions and means to enter in the first accumulator portion credit amounts from the credit unit, a second comparator circuit having first and second accumulator portions, a plurality of operator actuatable switches any one of which can be actuated by a customer depending on the quantity of articles at a particular unit price desired, distinct means operatively connecting each of said switches to the respective second accumulator portions of said first and of said second comparator circuits, actuation of a selected one of said switches operating to establish circuits to enter a predetermined total vend price in the second accumulator portion of the first comparator circuit and to establish other circuits to enter a desired quantity of articles to be vended in the second accumulator portion of the second comparator circuit, means producing a vend control signal wherever the total credit amount entered in the first accumulator portion of the first comparator circuit at least equals the total vend price entered in the second accumulator portion of said first comparator circuit, vend producing means responsive to control signals produced by the first comparator circuit, said vend producing means generating an output each time an article is vended, means for applying said outputs as inputs to the first accumulator portions of the second comparator circuit, and means to terminate a vending operation when the amount entered in the first accumulator portion of said second comparator circuit equals the amount entered in the second accumulator portion thereof.

5. The control circuit of claim 4 including refund output means associated with said first comparator circuit including means to produce a refund output signal to represent credit amounts entered in the first accumulator portion in excess of the total vend price entered in the second accumulator portion, and means responsive to said refund output signals to control refunding of said excess credit amounts.

6. Means to control vending from a vending machine of selectable numbers of items at a predetermined unit item price comprising a price comparator circuit and a quantity comparator circuit each having first and second entry portions and input and output connection means, means to enter a credit amount in the first entry portion of the price comparator circuit, operator actuatable vend selection means including a plurality of selectable switch means and respective means under control thereof for entering a predetermined total vend price into the second entry portion of the price comparator circuit and for entering a predetermined quantity amount representing a selected number of items to be vended into the second entry portion of the quantity comparator circuit, vend producing means having an input connected to receive outputs from the price and quantity comparator circuits to control the operation thereof, said price comparator circuit initiating a vend operation whenever an amount entered in the first entry portion thereof at least equals the total vend price entered in the second entry portion, output signal producing means associated with the vend producing means operatively connected to the first entry portion of the quantity comparator circuit for entry therein each time an item is vended, and means for producing an output signal on the output connection means of the quantity comparator circuit to terminate a vend operation whenever the amount entered in the first entry portion of the quantity comparator circuit is the same as the amount entered in the second entry portion thereof.

7. The means to control vending defined in claim 6, wherein the respective means associated with the plurality of selectable switch means includes a first matrix circuit and means in said first matrix circuit responsive to actuation of each of the selectable switch means to produce a different distinct binary amount for entering a total vend price into the second entry portion of the price comparator circuit, a second matrix circuit associated with each of said plurality of selectable switch means and responsive to actuation of each of said respective selectable switch means to enter into the second entry portion of the quantity comparator circuit an amount to represent the quantity of items to be vended during a vending operation.

8. Means to control vending from a vending machine of selectable numbers of items at a predetermined unit item price comprising a price comparator circuit and a quantity comparator circuit each having first and second entry portions and input and output connection means, means to enter a credit amount in the first entry portion of the price comparator circuit, operator actuatable vend selection means including a plurality of selectable switch means and respective means under control thereof for entering a predetermined total vend price into the second entry portion of the price comparator circuit, a vend producing circuit and means connecting the output connection means of the price comparator circuit to the input of the vend producing circuit to initiate a vend operation whenever an amount entered into the first entry portion of the price comparator circuit at least equals the total vend price entered into the second entry portion, said vend control circuit having a plurality of output connections operatively connected to means for producing distinct vend operations, means connecting the separate output connections of the vend control to the second entry portion of the quantity comparator circuit to enter into said second entry portion an amount to represent the quantity of articles to be vended, output signal producing means associated with the vend producing circuit operatively connected to the first entry portion of the quantity comparator circuit for making an entry therein each time an item is vended, and means for producing an output signal on the output connection means of the quantity comparator circuit to terminate a vend operation whenever the amount entered in the first entry portion of the quantity comparator circuit is the same as the amount entered into the second entry portion thereof.

9. Means to control vending from a vending machine of a selectable number of items at a predetermined unit item price comprising a price comparator circuit having first and second entry portions and input and output connection means, means to enter a credit amount in the first entry portion of the price comparator circuit, means to enter a total vend price into the second entry portion of the price comparator circuit, vend control means having input, output, and vend termination connections, means connecting the output of the price comparator circuit to the input of the vend control means to initiate a vend operation whenever the amount entered in the first entry portion of the price comparator circuit at least equals the total vend price entered in the second entry portion thereof, a vend control logic circuit having first and second entry portions, means connecting the outputs of the vend control means to the second entry portion of the vend control logic circuit to enter therein an amount representing the quantity of articles to be vended during a particular vending operation, other means operatively connected to the output of the vend control means including a vend motor and switch means under control thereof, and means including said switch means for feeding a signal to the first entry portion of said vend control logic circuit each time an item is vended, said vend control logic circuit producing an output for applying to the vend termination connection of the vend control means to terminate a vend operation whenever the amount entered in the first and second entry portions of the vend control logic circuit are the same.

10. A vend control circuit comprising a coin unit for receiving the deposit of coins and for producing output signals to represent the value of each coin deposited, a vendor control system operatively connected to the coin unit including means for producing a vend signal to initiate a vend function whenever the amount entered therein from the coin unit at least equals the total amount of a selected vend, vend producing means operatively connected to the vendor control system and responsive to signals produced thereby, customer actuatable means including means operable to select different quantities of articles at different selectable unit vend prices, said vend producing means generating an output signal for each article that is vended, means to terminate a vend operation when the number of articles vended corresponds to the quantity of articles selected by the customer to be vended including a quantity comparator circuit having a first entry portion and a second entry portion, means operatively connecting the output of the vendor control system to the second entry portion of the quantity comparator circuit to enter therein a quantity representing the number of articles to be vended during each vend operation, and means operatively connecting the output of the vend producing means to the first entry portion of said quantity comparator circuit for entering an amount therein for each article that is vended under control thereof.

11. A vend control circuit comprising a coin unit for receiving the deposit of coins and for producing output signals to represent the value of each coin deposited, a vendor control system operatively connected to the coin unit including means for producing a vend signal to initiate a vend function whenever the amount entered therein from the coin unit at least equals the total amount of a selected vend, vend producing means operatively connected to the vendor control system and responsive to signals produced thereby, customer actuatable means including means operable to select different quantities of articles at a selectable unit vend price including means to establish the vend price and the quantity of articles to be vended, said vend producing means including means for generating an output signal for each article that is vended, means operatively connected between the vend producing means and vendor or control system for feeding back output signals generated by the vend producing means to the vendor control system during each vend operation, means to terminate a vend operation when the number of articles vended corresponds to the quantity of articles selected by the customer to be vended, said vend signal producing means including a price comparator circuit having a first entry portion operatively connected to the coin unit for entering the total value deposited during a vending operation, said price comparator circuit having a second entry portion operatively connected to the customer actuatable means for entering therein the total vend price selected by the customer, means for refunding amounts deposited in excess of the total vend price selected by the customer, said refund means including an output connection associated with the price comparator circuit and means under control of signals produced on said output connection for refunding amounts deposited in excess of the vend price as represented by there being a greater entry in the first entry portion of the price comparator circuit than in the second entry portion thereof, and means for increasing the amount entered into the second entry portion of the price comparator circuit each time a refund is made unitl the amounts entered in the first and second entry portions are the same.

12. A vend control circuit comprising a coin unit for receiving the deposit of coins and for producing output signals to represent the value of each coin deposited, a vendor control system operatively connected to the coin unit including means for producing a vend signal to initiate a vend function whenever the amount entered therein from the coin unit at least equals the total amount of a selected vend, vend producing means operatively connected to the vendor control system and responsive to signals produced thereby, customer actuatable means including means operable to select different quantities of articles at different selectable unit vend prices, said vend producing means generating an output signal for each article that is vended, means to terminate a vending operation when the number of articles vended corresponds to the quantity of articles selected by the customer to be vended including a quantity comparator circuit having a first entry portion and a second entry portion means operatively connecting said second entry portion to the customer actuatable means whereby actuation by a customer of the customer actuatable means produces an entry into said quantity comparator circuit to represent the quantity of articles to be vended during a vending operation, said quantity comparator circuit having a first entry portion operatively connected to the vend producing means and responsive to the output signals produced for each article that is vended, said quantity comparator circuit having an output where signals are produced whenever the amount entered in the first portion thereof equals the quantity entered in the second entry portion, and said terminating means operatively connecting the output of the quantity comparator circuit to the vendor control system to terminate a vend operation whenever an output signal is produced at said output connection.

13. The vend control circuit defined in claim 12 including means to reset the quantity comparator circuit whenever a vend operation is terminated.

14. A vend control circuit comprising a coin unit for receiving the deposit of coins and for producing output signals to represent the value of each coin deposited, a vendor control system operatively connected to the coin unit including means for producing a vend signal to initiate a vend function whenever the amount entered therein from the coin unit at least equals the total amount of a selected vend, vend producing means operatively connected to the vendor control system and responsive to signals produced thereby, customer actuatable means including means operable to select different quantities of articles at a selectable unit vend price including means to establish the vend price and the quantity of articles to be vended, said vend producing means including means for generating an output signal for each article that is vended, means operatively connected between the vend producing means the vendor control system for feeding back output signals and generated by the vend producing means to the vendor control system during each vend operation, means to terminate a vend operation when the number of articles vended corresponds to the quantity of articles selected by the customer to be vended, said vend signal producing means including a price comparator circuit having a first entry portion and means connecting said first entry portion to the coin unit to enter therein the total amount deposited during each vend operation, said price comparator circuit having a first entry portion and means operatively connecting said second entry means to the customer actuatable means whereby actuation by a customer of said customer actuatable means produces an output for entry into the second entry portion of said price comparator circuit to represent the total vend price for a vend operation, said price comparator circuit having an output connection and means connecting said output connection to the vend producing means to initiate a vend operation whenever the amount entered into the first entry portion of the price comparator circuit at least equals the amount entered in the second portion thereof.

15. The vend control circuit defined in claim 14 including means to reset the price comparator circuit whenever a vend operation is terminated.

* * * * *

UNITED STATES PATENT AND TRADEMARK OFFICE

CERTIFICATE OF CORRECTION

PATENT NO. : 4,008,792
DATED : February 22, 1977
INVENTOR(S) : Joseph L. Levasseur and Larry D. Lee It is certified that error appears in the above-identified patent and that said Letters Patent are hereby corrected as shown below:

Column 1, line 22, after "U.S." insert "LETTERS".

Column 2, line 10, "itmes" should be "items"; line 33, "times" should be "items"; line 34, "times" should be "items".

Column 4, line 6, "motor" should be "motors".

Column 7, line 24, after "appropriate" insert "one"; line 55, "25" should be "20"; line 65, "compartor" should be "comparator".

Column 10, line 5, "vending" should be "vend".

Column 12, line 1, after "control" insert "circuit"; line 31, "outputs" should be "output".

Column 13, line 22, "or" should be deleted; line 46, "unitl" should be "until".

Column 14, line 2, after "portion" insert ","; line 38, after "means" insert "and"; line 49, "first" should be "second".

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*